United States Patent [19]

Adamitis

[11] 4,091,703

[45] May 30, 1978

[54] HARMONICA HORN

[75] Inventor: John P. Adamitis, Meadville, Pa.

[73] Assignee: The Raymond Lee Organization, Inc., New York, N.Y.

[21] Appl. No.: 729,590

[22] Filed: Oct. 4, 1976

[51] Int. Cl.[2] ..... G10D 9/00

[52] U.S. Cl. ..... 84/378

[58] Field of Search ..... 84/377–379

[56] References Cited

U.S. PATENT DOCUMENTS

| | | | |
|---|---|---|---|
| 666,686 | 1/1901 | Orlando | 84/378 |
| 681,753 | 9/1901 | Strieffler | 84/379 X |
| 1,951,928 | 3/1934 | Elkington | 84/378 |

*Primary Examiner*—Lawrence R. Franklin
*Attorney, Agent, or Firm*—Howard I. Podell

[57] ABSTRACT

A harmonica fitted with a shaped hollow resonating horn slidably mounted to the harmonica. The horn is mounted on the outlet side of the harmonica so that air passing through the reed chambers of the harmonica is exhausted through the horn. The horn is of a size to enclose the outlet of one or more reed chambers, and may be slid along a groove on the harmonica to fit about a selected group of adjacent reed chambers, so as to produce an echo of a desired musical chord, when the harmonica is sounded.

2 Claims, 5 Drawing Figures

HARMONICA HORN

SUMMARY OF THE INVENTION

My invention is a harmonica fitted with a shaped hollow resonating horn slidably mounted to the harmonica. The horn is mounted on the outlet side of the harmonica so that air passing through the reed chambers of the harmonica is exhausted through the horn. The horn is of a size to enclose the outlet of one or more reed chambers, and may be slid along a groove on the harmonica to fit about a selected group of adjacent reed chambers, so as to produce an echo of a desired musical chord, when the harmonica is sounded.

BRIEF DESCRIPTION OF THE PREFERRED EMBODIMENT

The objects and features of the invention may be understood with reference to the following detailed description of an illustrative embodiment of the invention, taken together with the accompanying drawings in which.

Figure 1:
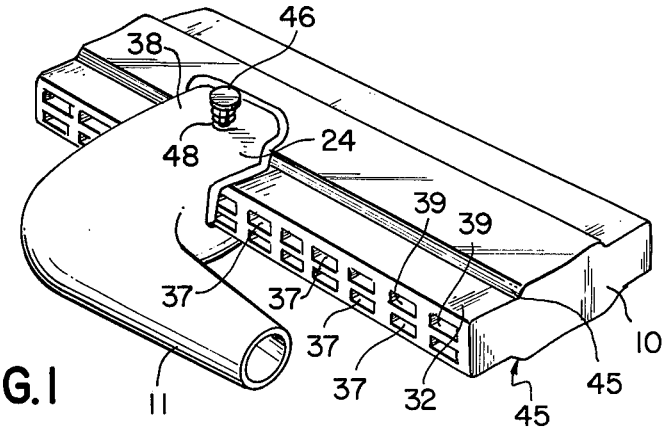
FIG. 1 is a perspective view of the invention in use.
Figure 2:
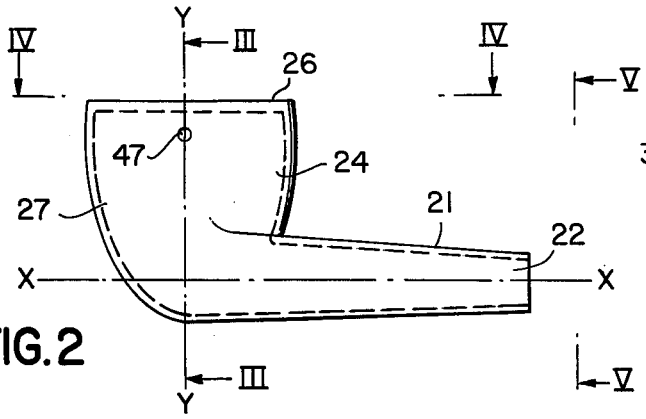
FIG. 2 is a side view of the horn.

DESCRIPTION OF THE PREFERRED EMBODIMENT:

Turning now descriptively to the drawings, in which similar reference characters denote similar elements throughout the several views, FIG. 1 illustrates the harmonica 10 to which a hollow horn 11 is slidably mounted so as to produce resonance or an echo of particular notes sounded by the reeds of the harmonica. Horn 11 as shown in FIGS. 1-5 is formed of a circular tube section 21 tapered to a minimum of exterior and interior diameters at the outlet opening 22 of the tube section 21, with tube section 21 joined to a hollow mount section 24. Mouth section 24 is of a generally circular cross-section in the plane that is parallel to the axis X—X of the tube section 21, with the interior and exterior diameters of said cross-section uniformly reducing in size along the axis Y—Y of the mouth section 24 from the exterior end wall 26 of the mouth section 24 to the tube section 21, and with the interior chamber 27 of the mouth section joined to the interior chamber 28 of the tube section, and with axis Y—Y generally perpendicular to axis X—X, and with the circular cross-section of tube section 21 reducing in size along axis X—X from the juncture with mouth section 24 to the outlet opening 22 of the tube section as shown in FIG. 2.

Figure 3:
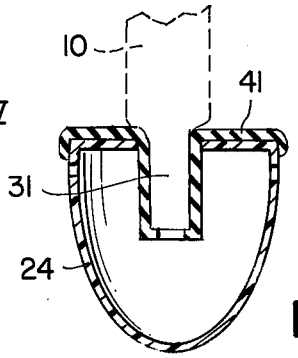
FIG. 3 is a sectional view of the horn, taken along line III—III of FIG. 2.
Figure 4:
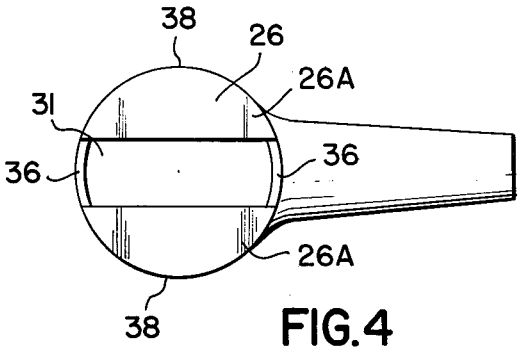
FIG. 4 is a plan view of the horn, taken along line IV—IV of FIG. 2.
Figure 5:
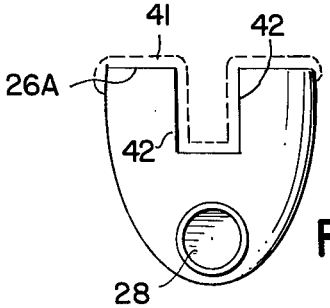
FIG. 5 is an end view of the horn, taken along line V—V of FIG. 2.

End wall 26 of mouth section 24 is formed with an open slot 31 parallel to the X—X axis, with slot 31 of a size to fit about the rear sides 32 of the harmonica 10, and with slot 31 extending through opposed side wall section 36 of mouth section 24 so that the opposed side wall sections 38 may fit over the respective opposed rear sides 32 of the harmonica to enclose one or more outlet openings 37 leading from a reed chamber 39 of the harmonica. A shaped flexible rubber seal 41, as shown in FIG. 3, fits about the edges 42 of wall 26 abutting mouth section 24 which abut harmonica sides 32, with seal 41 extending over each end wall section 26A of wall 26 so as to seal the chamber 27 to the outlets 37 enclosed by the horn 11.

A groove 45 extends on the exterior of each harmonica side 32 parallel to the axis of the harmonica with a pin 46 mounted in a hole 47 in each wall section 38 of the horn biased to bear against groove 45 by a tension spring 48, one end of which is fastened to pin 46 and the other end of which is fixed to wall section 38 through hole 47.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A harmonica fitted with a hollow shaped horn that extends about the outlet opening of one or more reed chambers of the harmonica, in which the horn is slidably mounted to the harmonica so as to slidable in use, with said horn formed of a first generally circular hollow section that fits about the harmonica with a first chamber in said first section extending to a second chamber in a second hollow section, which second chamber extends to an outlet opening of the second chamber in the second section, said second section being in the shape of a hollow tube, and with the said second chamber open at the free end of said second section, in which the said first chamber is of generally circular cross-section that decreases in size along a first axis extending from the juncture of the first section to the harmonica, and the second chamber is of generally circular cross-section that decreases in size along a second axis extending from the juncture of the second section, to the outlet opening of the second chamber, with said first and second axes being generally perpendicular to each other.

2. The combination as recited in claim 1 in which a pin is slidably mounted through a hole in a wall section of the first section and located to bear against the harmonica, said pin fitted with spring means to bias the pin against the harmonica, with said pin extending externally beyond the wall of the horn.

* * * * *